US012161282B2

(12) United States Patent
Barbier et al.

(10) Patent No.: US 12,161,282 B2
(45) Date of Patent: Dec. 10, 2024

(54) WET VACUUM CLEANER AND ARRANGEMENT OF COMPONENTS IN SUCH A WET VACUUM CLEANER

(71) Applicant: Hilti Aktiengesellschaft, Schaan (LI)

(72) Inventors: Lionel Barbier, Kaufering (DE); Svenja Müller, Friedberg (DE); Sonya Wörz, Penzing (DE); Georg Holzmeier, Marktoffingen (DE); Anna Mahr, Augsburg (DE)

(73) Assignee: Hilti Aktiengesellschaft, Schaan (LI)

( * ) Notice: Subject to any disclaimer, the term of this patent is extended or adjusted under 35 U.S.C. 154(b) by 144 days.

(21) Appl. No.: 17/441,546

(22) PCT Filed: Mar. 25, 2020

(86) PCT No.: PCT/EP2020/058275
§ 371 (c)(1),
(2) Date: Sep. 21, 2021

(87) PCT Pub. No.: WO2020/207797
PCT Pub. Date: Oct. 15, 2020

(65) Prior Publication Data

US 2022/0175203 A1 Jun. 9, 2022

(30) Foreign Application Priority Data

Apr. 9, 2019 (EP) ..... 19168015

(51) Int. Cl.
*A47L 7/00* (2006.01)

(52) U.S. Cl.
CPC ..... *A47L 7/0019* (2013.01); *A47L 7/0023* (2013.01)

(58) Field of Classification Search
CPC ..... A47L 7/0042; A47L 7/0019
See application file for complete search history.

(56) References Cited

U.S. PATENT DOCUMENTS 4,218,805 A 8/1980 Brazier et al.
5,836,046 A 11/1998 Huffman et al.
5,966,775 A * 10/1999 Berfield ..... A47L 11/4027 15/352
2004/0088817 A1* 5/2004 Cochran ..... A47L 9/2878 15/327.5

(Continued)

FOREIGN PATENT DOCUMENTS

CN 102366681 A 3/2012
CN 102934969 A 2/2013

(Continued)

OTHER PUBLICATIONS

WO 2018199344 A1 (machine translation) (Year: 2018).*
International Search Report of PCT/EP2020/058275, dated Jun. 25, 2020.

*Primary Examiner* — Andrew A Horton
(74) *Attorney, Agent, or Firm* — Davidson Kappel LLC

(57) ABSTRACT

An arrangement of components in a portable wet vacuum cleaner, wherein the wet vacuum cleaner includes a container for collecting a liquid-dirt mixture. The component arrangement is characterized, in particular, by a sloping sealing plane as the upper termination of a collecting container of the wet vacuum cleaner, wherein the sloping sealing plane includes a filter unit. In a second aspect, the invention furthermore relates to a wet vacuum cleaner having a component arrangement of this kind.

15 Claims, 2 Drawing Sheets

(56) References Cited

U.S. PATENT DOCUMENTS

| | | | | |
|---|---|---|---|---|
| 2006/0191099 | A1* | 8/2006 | Fry | A47L 7/0028 15/328 |
| 2008/0189901 | A1 | 8/2008 | Jansen | |
| 2009/0094778 | A1* | 4/2009 | Beers | A47L 9/2805 15/319 |
| 2010/0050368 | A1* | 3/2010 | Curien | A47L 1/08 15/374 |
| 2012/0234412 | A1 | 9/2012 | Prager et al. | |
| 2013/0081224 | A1 | 4/2013 | Van Der Kool et al. | |
| 2015/0135475 | A1* | 5/2015 | Foenss | A47L 9/1409 15/347 |
| 2016/0097705 | A1 | 4/2016 | Woolard et al. | |
| 2018/0132688 | A1* | 5/2018 | Walker | A47L 7/0019 |
| 2021/0279010 | A1 | 9/2021 | Duan et al. | |

FOREIGN PATENT DOCUMENTS

| | | | | |
|---|---|---|---|---|
| CN | 104644054 | A | 5/2015 | |
| CN | 204351755 | U | 5/2015 | |
| CN | 107110735 | A | 8/2017 | |
| CN | 108175344 | A | 6/2018 | |
| CN | 208612007 | U | 3/2019 | |
| DE | 102009028944 | A1 | 3/2011 | |
| DE | 202018104772 | U1 | 9/2018 | |
| EP | 0557096 | A1 | 8/1993 | |
| EP | 0827709 | A2 | 3/1998 | |
| JP | S52166809 | U | 12/1977 | |
| JP | H05168574 | A | 7/1993 | |
| JP | 2004160235 | A | 6/2004 | |
| JP | 2007503258 | A | 2/2007 | |
| WO | WO-2018199344 | A1 * | 11/2018 | A47L 11/4005 |

* cited by examiner

WET VACUUM CLEANER AND ARRANGEMENT OF COMPONENTS IN SUCH A WET VACUUM CLEANER

BACKGROUND

The present invention relates to an arrangement of components in a portable wet vacuum cleaner, wherein the wet vacuum cleaner comprises a container for collecting a liquid-dirt mixture.

SUMMARY OF THE INVENTION

The dust which arises on a construction site is often damaging to health and should not be inhaled by people. A distinction is usually drawn between primary and secondary dust. Primary dust is formed during various uses, such as drilling, chiseling or grinding of surfaces. This dust spreads out in the air and can easily be inhaled by people in the vicinity. The dust can also collect on the floor or on other surfaces and thereby becomes secondary dust. In respect of this secondary dust, there is the risk that the dust will be stirred up again during further work steps and will thus get into the airways of workers or passersby.

In order to avoid primary dust, use is usually made of a dust collector, which collects and/or extracts the dust directly at the point of formation thereof by means of suitable systems or attachments. This prevents dust from getting into the surrounding air and being inhaled by workers or passersby. To remove the secondary dust, use is likewise frequently made of a dust collector or a vacuum cleaner in order to selectively suck up the dust from the ground and dispose of it.

To avoid primary dust on construction sites, recourse is also had to water or other liquids, e.g. in order to bind the dust. The selective addition of water or liquid binds the dust formed and thereby prevents the dust from getting into the surrounding air. This procedure is used in cutting processes, for example. However, binding dust with the aid of liquids, e.g. water, leads to a liquid-dirt mixture, which likewise has to be disposed of or removed by suction. According to the invention, the liquid-dirt mixture or liquid-dust mixture is also preferably referred to as «sludge». In order to remove the sludge by suction, "wet vacuum cleaners" are known in the prior art, these being designed to pick up even liquid substances and sludges in order to dispose of them in a specifically intended manner. For this purpose, many wet vacuum cleaner systems have a collecting container in which the sludge or the collected liquid-dirt mixture can be held or temporarily stored before the collecting container or wet vacuum cleaner is emptied and its contents disposed of.

Conventional wet vacuum cleaner systems that are known from the prior art are generally based on the fact that the wet vacuum cleaners have a single defined position when they are in operation. Mobile wet vacuum cleaners can be moved across the floor on wheels, for example, wherein they are always upright and, in particular, are not tilted. During operation, an imaginary central axis extending centrally through the wet vacuum cleaner is generally substantially perpendicular to the underlying surface or the floor to be cleaned, over which the wet vacuum cleaner can be moved. By means of this defined operational position of the wet vacuum cleaner in space, it is possible to ensure that individual components of the wet vacuum cleaner do not come into contact with the sludge or the liquid-dirt mixture. In particular, the filter, the motor, the filter cleaning unit or the vacuum cleaner turbine should not be soaked with liquid.

If said components get wet in this way, this can lead to damage and malfunctioning of the wet vacuum cleaner or of its individual components.

In respect of the use of wet vacuum cleaners, mobile working is in increasing demand by users. Working as far as possible without cables, in which mobile energy sources such as storage batteries are used and act as energy sources for the mobile wet vacuum cleaners, for example, is desired, in particular. In order to further increase mobility in the use of wet vacuum cleaners, dust collector systems which can be carried on the back by means of carrying straps are known in the prior art. These systems can generally only be used "dry" since it is not possible to ensure that the position of the vacuum cleaner is upright and therefore that the filter, the filter cleaning unit, the motor and/or the turbine are in a dry position. According to the invention, "exclusively dry" use means that the corresponding dust collector is designed as a purely dry vacuum cleaner and is not designed to suck up sludge or liquids. It would be possible, in particular, for the at-risk components of a theoretical portable wet vacuum cleaner to come into contact with sludge and liquid if the user leaned forward with a vacuum cleaner of this kind on their back in order to pick up an object from the floor, for example. Owing to this tilting, the sludge situated in the collecting container within the wet vacuum cleaner would be moved in such a way that it could get into the region of the components which ought to be protected from the sludge and the fluid liquid-dirt mixture.

An object of the present invention is to provide a wet vacuum cleaner which does not have the defects and disadvantages of the prior art and can be used as a portable mobile system. In particular, another alternate or additional object is to develop a wet vacuum cleaner which enables the user to suck up even liquids and sludges without cables and in a highly mobile manner. It is a further alternate or additional object of the invention to develop a backpack dust collector which can handle and/or pick up even liquids. A yet further alternate or additional object is to be able use the wet vacuum cleaner in various, frequently occurring work situations that are associated with tilting of the vacuum cleaner in various directions without compromising potentially at-risk components, such as the turbine, the motor, the filter cleaning module and/or the filter, with the liquids contained in the sludge sucked up.

The present invention provides an arrangement of components in a portable wet vacuum cleaner, wherein the wet vacuum cleaner comprises a container for collecting a liquid-dirt mixture. The component arrangement is characterized in that an upper termination of the collecting container comprises a sloping sealing plane, wherein the sloping sealing plane comprises a filter unit. The sealing plane can slope within an angular range of 20 to 60 degrees, for example. Tests have shown that slope angles in this angular range are a particularly effective way of preventing water or sludge from being able to enter the suction hose.

The present invention also provides a wet vacuum cleaner which comprises a component arrangement according to the invention. The terms, definitions and technical advantages introduced for the component arrangement preferably apply analogously to the proposed wet vacuum cleaner. In particular, the wet vacuum cleaner can be carried on the back of a user. For this purpose, the wet vacuum cleaner can comprise the corresponding fastening means or belts to enable the user to carry the wet vacuum cleaner in a pleasant and comfortable manner. According to the invention, it is particularly preferred that the wet vacuum cleaner has a collecting container, the rear side of which faces the back of the user when the wet vacuum cleaner is being carried on the back of the user. The front side of the collecting container is preferably substantially parallel to the rear side of the collecting container, while a lower side or bottom surface of the collecting container is formed substantially perpendicularly to the rear side and/or the front side of the collecting container. The collecting container is preferably closed off in an upper region by an upper termination, wherein this upper termination is preferably arranged opposite the lower or bottom side of the collecting container. According to the invention, it is preferred that the upper termination is also referred to as the upper side of the collecting container. The upper side of the collecting container preferably comprises a sloping sealing plane, wherein the sloping sealing plane comprises a filter unit of the wet vacuum cleaner. The container for collecting a liquid-dirt mixture is preferably also referred to as a collecting container, and the arrangement of components in the backpack vacuum cleaner is preferably also referred to as a component arrangement.

One particular advantage of the invention is that the proposed backpack vacuum cleaner can be used independently of position. According to the invention, the term "independently of position" preferably means that the vacuum cleaner can be used particularly in frequently occurring work situations that may be associated with tilting of the wet vacuum cleaner. These frequently occurring work situations preferably define allowed tilted states, wherein the slope of the sealing plane within the collecting container of the backpack vacuum cleaner advantageously makes it possible to ensure that the proposed wet vacuum cleaner can be used in these allowed tilted states without the vacuum cleaner components, such as the motor, the turbine, the filter cleaning unit and/or the filter, coming into contact with liquid or sludge. In particular, allowed tilted states exist in the following situations: when a) the wet vacuum cleaner is tilted forward by between 0 and 90 degrees, b) when the wet vacuum cleaner is tilted to the side by less than 30 degrees, preferably less than 20 degrees, and/or c) when the wet vacuum cleaner is tilted rearward by less than 30 degrees. Accordingly, tilted states that are not allowed can exist, in particular, when a) the wet vacuum cleaner is tilted forward by more than 90 degrees, b) when the wet vacuum cleaner is tilted to the side by more than 20 degrees, preferably more than 30 degrees, and/or c) when the wet vacuum cleaner is tilted rearward by more than 30 degrees. The angles mentioned are preferably viewed from a substantially vertically extending axis, wherein this substantially vertically extending axis represents an imaginary or virtual axis which preferably extends substantially parallel to a spinal column of the user. According to the invention, the «forward» spatial direction preferably relates to «bending forward» by the user, during which the upper body of the user bends forward, i.e. into the spatial direction which is away from the back of the user or in the direction of the stomach of the user. A distance between the face and the stomach of the user is preferably shortened during the «bending forward» of the user. The «rearward» spatial direction preferably corresponds to «bending backward» by the user, wherein, during «bending backward» by the user, a distance between the front side of the wet vacuum cleaner and the floor is preferably reduced. In the context of the present invention, the spatial directions «forward» and «rearward» preferably do not correspond to the side face designations of the collecting container or of the wet vacuum cleaner. That side of the wet vacuum cleaner or of the collecting container which faces the user or the back of the user is preferably designated as the «rear side» of the wet vacuum cleaner or of the collecting container, while the opposite side of the wet vacuum cleaner or of the collecting container is designated as the «front side» of the wet vacuum cleaner or of the collecting container.

According to the invention, it is very particularly preferred that the filter of the wet vacuum cleaner is arranged on a side facing away from the «forward tilting direction». In other words, it is preferred in the context of the invention that the filter is arranged in the region of the upper side of the collecting container, more specifically in the direction of the front side of the collecting container, which preferably faces away from the back of the user when the user is carrying the backpack vacuum cleaner on their back. By virtue of this preferred arrangement of the filter within the vacuum cleaner, it is advantageously achieved that the filter is not soaked with liquid or does not come into contact therewith, even when the wet vacuum cleaner is tilted, particularly in the forward spatial direction, as long as tilting takes place in the allowed angular ranges.

In one embodiment of the invention, it is preferred that the wet vacuum cleaner comprises a gyrosensor, which is designed to detect tilting of the wet vacuum cleaner. The detection of the tilted states that are not allowed is preferably accomplished with the aid of the abovementioned angle values and using the gyrosensor. For example, a state which is not allowed is detected if a user who is carrying the backpack vacuum cleaner on their back bends forward by more than 90 degrees. With the gyrosensor, the wet vacuum cleaner is preferably capable of ensuring that the wet vacuum cleaner is switched off if tilted states that are not allowed are detected. In the example mentioned, the gyrosensor detects the presence of a tilted state that is not allowed if the carrier of the wet vacuum cleaner were to bend forward by more than 90 degrees. The wet vacuum cleaner the is switched off automatically—e.g. using a control device, which is connected to the gyrosensor and to the wet vacuum cleaner, or can exchange information and/or control commands therewith—in order to avoid the sludge or the moisture in the collecting container of the vacuum cleaner getting into the region of the filter unit or of the sealing plane of the collecting container or of the wet vacuum cleaner. The wet vacuum cleaner preferably comprises a gyrosensor which is designed to switch off the wet vacuum cleaner from a tilting angle of 90° "forward", 20-30° to the left or right and up to 30° "rearward" and thus to prevent water being sucked into the turbine through the filter. In particular, the gyrosensor can communicate with a control unit of the wet vacuum cleaner in such a way that the liquid-dirt mixture is prevented from being sucked in if there is a tilted state that is not allowed. This can be achieved, for example, by switching off the motor and/or the turbine of the wet vacuum cleaner if the gyrosensor detects a tilted state that is not allowed. According to the invention, it is preferred that the wet vacuum cleaner is operated, in particular, in the allowed tilted states, wherein the allowed tilted states correspond, in particular, to the frequently occurring work situations that may be associated with tilting of the wet vacuum cleaner in the abovementioned "allowed" angular ranges.

The upper termination of the collecting container, which comprises the sloping sealing plane and the filter unit, can preferably also be referred to as the upper side of the collecting container. The upper side of the collecting container can preferably have two different sections or can be formed by these different sections. According to the invention, it is particularly preferred that the upper side of the collecting container comprises a substantially horizontally formed section, wherein the substantially horizontally formed section is designed to connect a rear side of the collecting container and the sloping sealing plane. In other words, the substantially horizontally formed section of the upper side of the collecting container is situated between the sloping sealing plane and the rear side of the collecting container. To put it yet another way, the collecting container comprises an upper horizontal edge, thus enabling as large as possible a tilting angle of the wet vacuum cleaner to be achieved without the collected water flooding the sealing surface and, for example, the components contained therein, such as the filter unit. By virtue of its position, the sealing plane preferably also protects the components arranged above the sealing plane, such as the turbine, the filter cleaning unit and/or the motor. By virtue of the position of the sealing plane within the wet vacuum cleaner or of the backpack vacuum cleaner, a sufficiently large space for the optimized arrangement of the components to be protected from the dirty water is provided in the upper region, while a sufficiently large space to receive the liquid-dirt mixture is obtained in the lower region of the vacuum cleaner. According to the invention, the region above the sealing plane is preferably referred to as the sealing space. In other words, the sloping arrangement of the sealing plane which comprises the filter unit makes possible optimum division of the space within the proposed wet vacuum cleaner. It is thereby possible, on the one hand, to pick up a large quantity of sludge before emptying of the collecting container is required. On the other hand, the components of the vacuum cleaner which should be protected from the sludge, such as the motor, the turbine, the filter cleaning unit and/or the filter unit can be protected in an optimum manner from coming into contact with the liquid. Consequently, they are protected in a particularly effective manner by the proposed arrangement of the components from unwanted soaking, and it is therefore surprisingly possible with the proposed invention to provide a portable backpack wet vacuum cleaner that can be used even in frequently occurring work situations that are associated with tilting of the wet vacuum cleaner. The invention thereby represents a turning away from the prior art since those skilled in the art had previously assumed that wet vacuum cleaners could not be supplied as backpack vacuum cleaners. Those skilled in the art had developed this prejudice because it had previously been assumed that it was not possible to arrange the components of a mobile portable wet vacuum cleaner in such a way that wetting or soaking of at-risk components of the vacuum cleaner could be prevented even if the vacuum cleaner were tilted by bending movements of the user.

According to the invention, it is preferred that the filter cleaning module of the wet vacuum cleaner is arranged centrally above the filter unit. In other words, the wet vacuum cleaner preferably comprises a filter cleaning module, which is, in particular, arranged substantially centrally above the filter unit. Since the filter unit is preferably arranged in the sloping sealing plane of the collecting container, it is preferred according to the invention that the filter cleaning unit is arranged as an extension of an imaginary central axis preferably extending centrally through the filter unit. The arrangement of the filter cleaning module is also illustrated in the figures. According to the invention, it is preferred that the filter cleaning module is also referred to as an APFC module of the wet vacuum cleaner. According to the invention, it is particularly preferred that the filter cleaning unit is positioned substantially centrally above the filter. By means of this substantially central arrangement of the filter cleaning unit above the filter, optimum filter cleaning is advantageously achieved.

According to the invention, it is preferred that the wet vacuum cleaner comprises an energy supply unit, wherein the energy supply unit is arranged substantially above the substantially horizontally formed section of the upper termination of the collecting container. In particular, the energy supply unit can be storage batteries, which allow cable-free use of the wet vacuum cleaner. The wet vacuum cleaner preferably comprises a turbine, wherein the turbine is arranged substantially above the substantially horizontally formed section of the upper termination of the collecting container. In other words, it is preferred according to the invention that the energy supply unit and the turbine are arranged side-by-side and in spatial proximity to the rear side of the collecting container. An illustrative arrangement of the energy supply unit and the turbine of the wet vacuum cleaner is illustrated in the figures. By virtue of the fact that the energy supply unit and the turbine are arranged above the sealing plane of the wet vacuum cleaner, the possibility of water, sludge or liquid penetrating into the upper region of the vacuum cleaner is avoided in an effective manner with the invention, with the result that the energy supply unit and the turbine are protected in an effective manner from water, sludge or liquid. According to the invention, it is particularly preferred that the upper region of the wet vacuum cleaner forms a sealed region or a sealing region, wherein the turbine and the energy supply unit are arranged in this sealing region. By virtue of the preferred arrangement of the energy supply unit and of the turbine side-by-side and in spatial proximity to the rear side of the collecting container, in particular in the sealing region of the wet vacuum cleaner, optimum weight distribution within the wet vacuum cleaner is achieved, in particular, this being particularly advantageous if the backpack vacuum cleaner is carried on the back of a user. In particular, the «heavy» components, such as the storage batteries and the turbine are close to the user by virtue of this preferred arrangement, and therefore the weight of the vacuum cleaner is not unnecessarily increased by a remote arrangement of these components.

According to the invention, it is preferred that a suction hose opens into the collecting container by means of an inlet connector in the region of a suction hose connection, wherein the suction hose connection is arranged in the region of the upper termination of the collecting container. According to the invention, it is very particularly preferred that the hose inlet is arranged as far up as possible in the collecting container. Moreover, it may be preferred that the suction hose connection is arranged between the filter unit and the substantially horizontally formed section of the upper termination of the collecting container. According to the invention, it is particularly preferred that the suction hose connection opens into the collecting container in the region of the sloping sealing plane. The preferred arrangement of the hose inlet as far up as possible in the collecting container advantageously prevents water from running out of the collecting container through the hose in a tilted position of the vacuum cleaner.

The inlet connector can preferably be designed as a diffuser. According to the invention, it is very particularly preferred that the rear side of the collecting container serves as a deflecting wall for the water-dirt mixture sucked in. A hose inlet opening on the collecting-container side is preferably oriented toward the rear side of the collecting container, with the result that the dirt-liquid mixture which is being sucked into the collecting container by means of the vacuum cleaner is first of all sucked substantially horizontally into the collecting container, wherein the rear side of the collecting container can act as a deflecting wall in order to effect deceleration or retardation of the mixture. The use of the rear side of the collecting container as a deflecting wall ensures that the medium sucked in cannot reach the filter directly. This prevents the material sucked in from getting into the region of the filter and wetting or contaminating the filter. In particular, the substantially horizontal sucking in of the dirt-liquid mixture allows optimum distribution of the dirt in the collecting container, contributing to the sludge remaining in the region of the bottom of the collecting container, even if the wet vacuum cleaner is tilted.

According to the invention, it is preferred that the wet vacuum cleaner comprises probes for detecting a surface of the liquid-dirt mixture. According to the invention, it is particularly preferred that a filling quantity of the collecting container can be detected by means of the probes. In other words, the probes are designed to limit a filling quantity of the collecting container inasmuch as the filling level is detected and, if required, corresponding measures can be derived. According to the invention, it is very particularly preferred that the data which are determined by means of the probes are evaluated by a control device of the wet vacuum cleaner, wherein, in particular, the control device is designed to initiate appropriate measures in accordance with the determined filling levels within the collecting container. For example, the quantity of the liquid-dirt mixture in the collecting container can be limited by a length of the probes in that the suction process is switched off if the probes detect that a critical filling level of the collecting container is exceeded or that the liquid-dirt mixture is coming too close to the filter unit.

According to the invention, it is very particularly preferred that the probes are designed to determine the surface of the liquid-dirt mixture in the collecting container, thus enabling contact between the liquid-dirt mixture and the filter unit to be prevented. The probes preferably project into the container beyond the lowermost point of the filter in order to detect the surface of the liquid-dirt mixture. According to the invention, the surface of the liquid-dirt mixture can also be referred to as the filling level of the collecting container, wherein a person skilled in the art knows that this filling level may also be tilted in the context of the present invention. This can occur, for example, if the user of the wet vacuum cleaner who is carrying the wet vacuum cleaner, preferably designed as a backpack vacuum cleaner, on their back bends forward. According to the invention, it is preferred that the probes are arranged above and/or below or to the right and/or left of the filter unit. In other words, the probes can be arranged between the filter unit and the suction hose inlet or between the filter unit and the substantially horizontally formed section of the upper termination of the collecting container. This arrangement of the probe is preferably referred to as «to the left» of the filter unit. On the other hand, a probe can be arranged between the filter unit and the front side of the collecting container. This arrangement of the probe is preferably referred to as «to the right» of the filter unit. The probes preferably form a substantially semicircular arrangement, wherein a radius of the substantially semicircular probe arrangement can be arranged substantially perpendicularly to the sealing plane of the collecting container. The probes advantageously ensure that the turbine or the vacuum cleaner is switched off upon contact with sludge or water in order to protect the motor and/or the filter.

According to the invention, it is preferred that the filter unit comprises a flat fold filter or is formed by a flat fold filter. As an alternative, the use of a cartridge filter may be preferred according to the invention, wherein such a cartridge filter may have a ball shutoff element in its interior. The ball shutoff element preferably comprises a ball, which floats on the water or the sludge as a filling level in the collecting container rises and which may block the inlet to the turbine.

According to the invention, it is preferred that the filter comprises a polyester material (PES) or is formed from a PES material. In particular, the filter can have a surface coating. Through the use of a filter made from PES with a surface coating, it is advantageously possible to delay the water or the sludge trickling through the filter to the turbine and/or to the motor of the wet vacuum cleaner. In particular, penetration of moisture and sludge into the sealing region above the sealing plane is thereby prevented. In the context of the present invention, it is possible, in particular, to use a universal filter, which is impermeable to water for 10 minutes, for example, outside suction operation.

Sealing between the vacuum cleaner head of the wet vacuum cleaner and the collecting container can preferably be achieved via a rubber seal and by pressing the head onto the container. In particular, sponge rubber can be used as a material for the rubber seal. The seal can preferably be embodied as a hinge for hooking in with a toggle lever for clamping. The vacuum cleaner head can preferably be fitted on the turbine side, which preferably corresponds to a user side, and clamped onto the container via one or more toggle levers in order to apply as high and uniform as possible pressure to the seals. This ensures particularly good sealing between the container and the vacuum cleaner head.

Further advantages will become apparent from the following description of the figures. The figures, the description and the claims contain numerous features in combination. A person skilled in the art will expediently also consider the features individually and combine them to form expedient further combinations.

BRIEF DESCRIPTION OF THE DRAWINGS

In the figures, identical components and components of identical type are designated by the same reference signs. In the figures.

DETAILED DESCRIPTION

Figure 1:
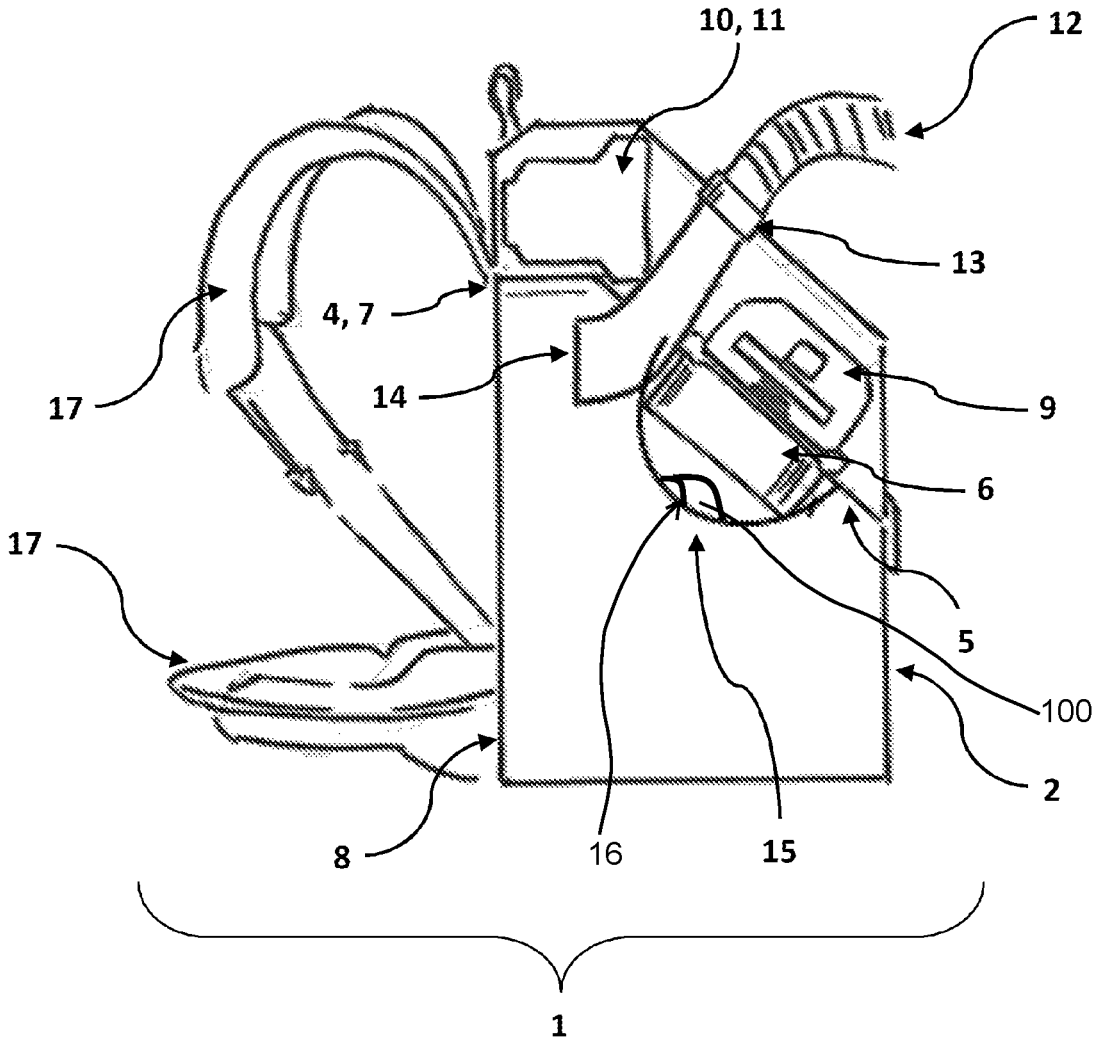
FIG. 1 shows a side view of a preferred configuration of the invention

FIG. 1 shows a side view of a preferred configuration of a proposed wet vacuum cleaner (1). It illustrates the wet vacuum cleaner (1) which is designed, in particular, as a portable backpack vacuum cleaner. The wet vacuum cleaner (1) can be carried by a user on their back, wherein the preferred embodiment of the invention which is illustrated in FIG. 1 comprises carrying straps (17) which assist or facilitate the carrying of the wet vacuum cleaner (1). The wet vacuum cleaner (1) comprises a collecting container (2), in which a liquid-dirt mixture or sludge (3, see FIGS. 2*a* and 2*b* for example) that has previously been sucked in by the wet vacuum cleaner (1) through the suction hose (12) can be collected. The sludge (3) passes via a suction hose connection (13) into the collecting container (2), wherein the suction hose (12) comprises, in particular, an inlet connector (14) in its region of entry to the collecting container (2). The inlet connector (14) can preferably be designed as a diffuser, wherein an opening of the inlet connector (14) is formed substantially parallel to a rear side (8) of the collecting container (2). As a result, the rear side (8) of the collecting container (2) can act as a deflecting wall for the liquid-dirt mixture (3) sucked in.

The collecting container (2) preferably forms the lower region of the wet vacuum cleaner (1). The collecting container (2) is preferably bounded at the top by an upper termination (4), which furthermore forms the boundary with respect to an upper region of the wet vacuum cleaner (1). According to the invention, the upper region of the wet vacuum cleaner (1) is preferably referred to as the sealing region. The upper termination (4) is preferably formed by two sections (5, 7), wherein a substantially horizontally formed section (7) is oriented in the direction of the rear side (8) of the collecting container (2), while a sloping sealing plane (5) is oriented in the direction of the front side of the collecting container (2). The substantially horizontally formed section (7) of the upper termination (4) of the collecting container (2) is preferably formed substantially horizontally in relation to a flat bottom surface of the collecting container (2) of the wet vacuum cleaner. The substantially horizontally formed upper edge (4) of the collecting container (2) allows, in particular, a particularly large tilting angle of the wet vacuum cleaner (1) without the collected sludge (3) in the collecting container (2) flooding the sealing surface (5) or the filter unit (6) or getting into the suction hose (12).

The sealing plane (5) preferably forms the second section of the upper termination (4) of the collecting container (2). The sealing plane (5) comprises the filter unit (6) of the wet vacuum cleaner (1), which is to be protected, in particular, from contact with the sludge (3). To ensure this, the wet vacuum cleaner (1) comprises probes (15), via which the filling level of the sludge (3) in the collecting container (2) can be determined. The probes (15) preferably form a substantially semicircular arrangement, the lowest point of which projects into the collecting container (2) and, when there is contact with the sludge (3), outputs a signal which can be evaluated by a control device (100 shown schematically) of the wet vacuum cleaner (1). According to the invention, it may be preferred, for example, that the wet vacuum cleaner (1) switches off automatically when the probes (15) are in contact with the sludge (3) or detect a filling level of the dirt-liquid mixture (3) which is classified as risky or dangerous. Through the provision of the probes (15), which surround the filter unit (6) in the sealing plane (5), for example, it is possible to prevent the filter unit (6) from coming into contact with the sludge (3). This could lead to sludge (3) or liquid (3) getting into the space above the sealing plane (5) owing to soaking of the filter (6). Such unwanted soaking is avoided in an effective manner owing to the arrangement of the filter unit (6) in the sloping sealing plane (5), and the components in the sealing space arranged above the collecting container (2) are protected in an effective manner from water and sludge (3). The turbine (11) and the energy supply unit (10), in particular, are arranged in the sealing space arranged above the collecting container (2) (only one of the two objects is visible in the side view). The turbine (11) and the energy supply unit (10) are preferably situated above the substantially horizontally formed section of the upper termination (4) of the collecting container (2), wherein the turbine (11) and the energy supply unit (10) can, in particular, be arranged side-by-side in the sealing space.

Arranged above the filter unit (6) and after the filter unit (6) in terms of flow, the filter cleaning unit (9), which is also referred to as the APFC module, projects into the sealing space arranged above the collecting container (2). This cleaning unit is also protected from sludge (3) and water by the sealing plane (5) and the filter unit (6) contained therein. Moreover, the wet vacuum cleaner (1) can have a gyrosensor (16).

Figure 2:
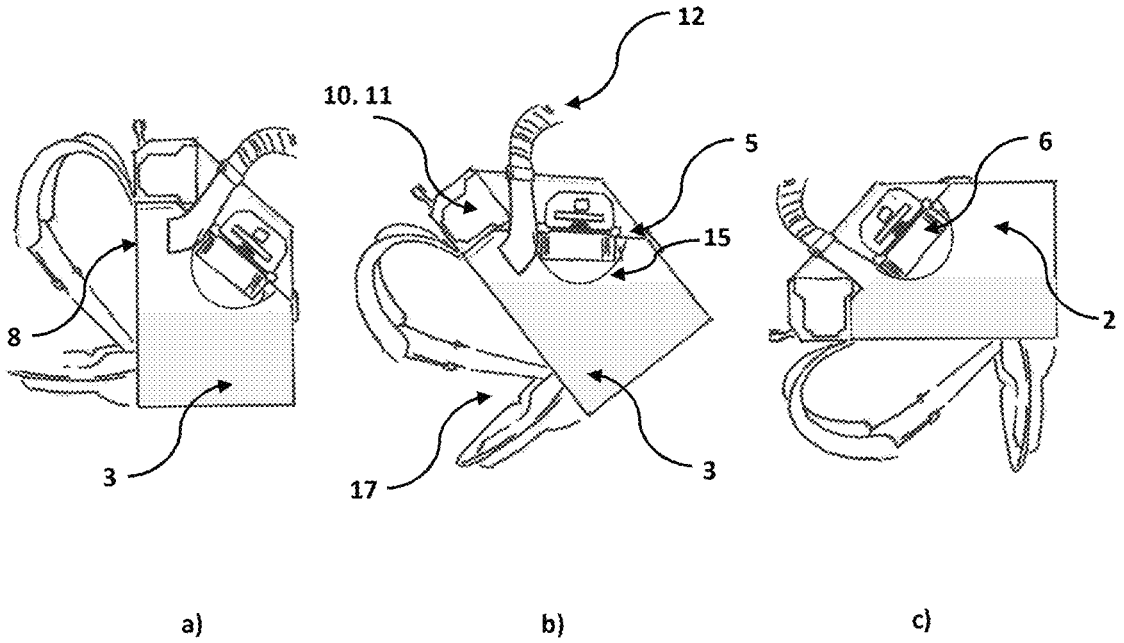
FIGS. 2*a*, 2*b* and 2*c* show various tilted states of a preferred configuration of the wet vacuum cleaner

FIG. 2 shows various tilted states of a preferred configuration of the wet vacuum cleaner (1). FIG. 2*a* shows the wet vacuum cleaner (1) in an upright position. In this position, the wet vacuum cleaner (1) is, for example, being carried by an upright user who is not bending forward, backward or to the side in any direction. Thus, all the tilting angles are zero degrees and the wet vacuum cleaner (1) illustrated in FIG. 2*a* is in an allowed tilted state, wherein the upright state of the wet vacuum cleaner (1) illustrated in FIG. 2*a* represents a special state of the allowed state. In the allowed tilted state, it is possible with the proposed component arrangement to ensure that the filter unit (6) is not completely softened and that no water or sludge (3) gets out of the collecting container (2) into the sealing space above the sealing plane (5) or into the suction hose (12). In the case of use illustrated in FIG. 2*a*, a filling level of the liquid-dirt mixture (3) is below the probes (15), which preferably form a semicircular arrangement. The probes (15) preferably surround the filter unit (6), which is situated in the sloping sealing plane (5).

FIG. 2*b* too shows an allowed tilted state, wherein the wet vacuum cleaner (1) slopes forward by 40 degrees in the example shown in FIG. 2*b*, for example. This results in an oblique position of the collecting container (2), with the result that the sludge (3) also forms an oblique filling level surface within the collecting container (2). In the example shown in FIG. 2*b*, the filling level of the sludge (3) is just below the probes (15), which can detect the filling level of the sludge (3) or can output a signal if they come into contact with the liquid-dirt mixture (3). It can clearly be seen that the filling level of the sludge (3) in the case of the forward tilting of the wet vacuum cleaner (1) which is illustrated in FIG. 2*b* is not sufficient to reach the filter unit (6). Moreover, no sludge (3) gets into the suction hose (12) in the allowed tilted state illustrated in FIG. 2*b*. The substantially horizontally formed section (7) of the upper side (4) of the collecting container (2) in conjunction with the sealing plane (5) furthermore protects the turbine (10) and the energy supply unit (10) from the sludge (3).

FIG. 2*c* shows a transition between a tilted state of the wet vacuum cleaner (1) which is allowed and one which is not allowed. In the case of the exemplary embodiment of the invention which is illustrated in FIG. 2*c*, there is a tilt by 90 degrees in the «forward» spatial direction, still just representing an allowed tilted state, while tilted states with larger slope angles represent prohibited tilted states, in which the wet vacuum cleaner (1) switches off automatically. In the tilted state of the wet vacuum cleaner (1) which is not allowed, sludge (3) can get into the suction hose (12), for example. FIG. 2*c* shows clearly that, despite the pronounced forward tilting of the wet vacuum cleaner (1), the filter unit (6) continues to be protected from contact with the sludge (3) by the slope of the sealing plane (5). The tilted state of the wet vacuum cleaner (1) which is illustrated in FIG. 2*c* is assumed, for example, when a user who is carrying the wet vacuum cleaner (1) on their back bends forward to a great extent. The wet vacuum cleaner (1) is preferably designed in such a way that the turbine (11) is switched off when a tilted state that is not allowed is assumed, with the result that the suction process is ended. The motor and the filter (6) of the wet vacuum cleaner (1) can thereby be protected from moisture, contaminants and damage. Other states that are not allowed can be assumed by severe tilting to the side or backward, for example. It is also possible for a user to bend both to the side and forward or backward. The proposed wet vacuum cleaner (1) is preferably designed to handle overlapping tilted states and to bring about switching off of the turbine (11) or ending of the suction process if there is a risk to the sensitive components of the wet vacuum cleaner (1), such as the turbine (11), the filter (6), the cleaning unit (9) and/or the motor.

LIST OF REFERENCE SIGNS

1 Wet vacuum cleaner
2 Collecting container
3 Liquid-dirt mixture/sludge
4 Upper termination of the collecting container
5 Sealing plane
6 Filter unit
7 Substantially horizontally formed section
8 Rear side
9 Filter cleaning module
10 Energy supply unit
11 Turbine
12 Suction hose
13 Suction hose connection
14 Inlet connector
15 Probes
16 Gyrosensor
17 Carrying straps
100 Controller

What is claimed is:

1. A portable wet vacuum cleaner comprising:

a container for collecting a liquid-dirt mixture, the container in an upright position having, in cross section, a bottom, an upper termination opposite the bottom and having a horizontally formed section, a sloping sealing plane sloping with respect to the horizontally formed section, a rear side and a front side, the horizontally formed section connecting the rear side and the sloping sealing plane;

a suction hose having an inlet connector passing through the upper termination and having an opening spaced from the rear side, the suction hose having a segment at the exterior of the vacuum cleaner, the upper termination and the sealing plane being inside of the vacuum cleaner, the upper termination and the sealing plane being one body;

straps connected to the rear side; and a filter unit attached to the sloping sealing plane.

2. The portable wet vacuum cleaner as recited in claim 1 further comprising a filter cleaning module of the wet vacuum cleaner arranged centrally above the filter unit.

3. The portable wet vacuum cleaner as recited in claim 1 further comprising an energy supply unit arranged substantially above the horizontally formed section.

4. The portable wet vacuum cleaner as recited in claim 1 further comprising a turbine arranged substantially above the horizontally formed section.

5. The portable wet vacuum cleaner as recited in claim 4 further comprising an energy supply unit arranged substantially above the horizontally formed section and wherein the energy supply unit and the turbine are arranged side-by-side and in spatial proximity to the rear side of the collecting container.

6. The portable wet vacuum cleaner as recited in claim 1 wherein the inlet connector is a diffuser with the opening parallel to the rear side.

7. The portable wet vacuum cleaner as recited in claim 1 further comprising probes for detecting a surface of the liquid-dirt mixture.

8. The portable wet vacuum cleaner as recited in claim 1 further comprising a gyrosensor designed to detect tilting of the wet vacuum cleaner.

9. The portable wet vacuum cleaner as recited in claim 1 wherein the filter unit includes a flat fold filter.

10. The portable wet vacuum cleaner as recited in claim 1 wherein the straps include two shoulder straps.

11. The portable wet vacuum cleaner as recited in claim 10 wherein the straps include a waist strap.

12. The portable wet vacuum cleaner as recited in claim 11 wherein the shoulder straps and waist strap are attached to a rear side of the container, the rear side of the container for resting against a back of an operator of the portable wet vacuum cleaner.

13. The portable wet vacuum cleaner as recited in claim 1 wherein the sloping sealing plane is sloped with respect to the rear side.

14. The portable wet vacuum cleaner as recited in claim 1 further comprising a probe having a semicircular section arranged perpendicularly to the sealing plane.

15. The portable wet vacuum cleaner as recited in claim 14 wherein the probe surrounds the filter unit in the sealing plane to protect the filter unit.

* * * * *